United States Patent [19]

Klaus

[11] Patent Number: 4,674,889

[45] Date of Patent: Jun. 23, 1987

[54] WATCH

[75] Inventor: Kurt Klaus, Schaffhausen, Switzerland

[73] Assignee: IWC International Watch Co. AG, Schaffhausen, Switzerland

[21] Appl. No.: 826,180

[22] Filed: Feb. 5, 1986

[30] Foreign Application Priority Data

Feb. 20, 1985 [DE] Fed. Rep. of Germany ..... 3505733

[51] Int. Cl.[4] ..... G04B 19/24; G04B 19/26

[52] U.S. Cl. ..... 368/28; 368/15; 368/34; 368/37

[58] Field of Search ..... 368/28, 31–37, 368/18, 15, 223, 228

[56] References Cited

U.S. PATENT DOCUMENTS

| | | | |
|---|---|---|---|
| 1,874,348 | 8/1932 | Prenszner | 368/37 |
| 1,997,511 | 4/1935 | Canepa | 368/37 |
| 2,147,289 | 2/1939 | Basler | 368/35 |
| 3,721,083 | 3/1973 | Jauch | 368/8 |

FOREIGN PATENT DOCUMENTS

| | | | |
|---|---|---|---|
| 134279 | 10/1919 | United Kingdom | 368/37 |

*Primary Examiner*—Vit W. Miska

*Attorney, Agent, or Firm*—Martin A. Farber

[57] ABSTRACT

A watch having a crown for setting the motion work and having a device, which can be driven by the hour wheel of the movement of the watch, for the automatic display of the months and the days of the month in accordance with the Gregorian calendar. In this connection, the display of the day of the month can be driven by a date wheel 13 and the display of the month by a month wheel 22 of the device. A year wheel of a year display and a decade wheel 26 of a decade display and possibly a century drive of a century display form together with the wheelwork of the month display and the day of the month display a closed coupling-less calendar wheelwork train whose date wheel 13 can be set by a correction device.

17 Claims, 5 Drawing Figures

WATCH

FIELD AND BACKGROUND OF THE INVENTION

The present invention relates to a watch having a crown for setting the hands as well as a device, which can be driven by the hour wheel of the watch movement, for automatically displaying the month and the day of the month in accordance with the Gregorian calendar, the day-of-the-month display being adapted to be driven by a date wheel of the device and the month display being adapted to be driven by a month wheel of the device.

In such known watches, a correction of the individual calendar displays is effected by correction buttons. In order to equalize the differences in the number of days in the month, particularly for February and also with due consideration of leap years, the advancing connection from the date wheel to the month wheel is provided with suitable mechanical programming.

Upon a correction of the calendar displays after the watch has been standing for a particularly long period of time it may happen that the mechanical programming of the advancing connection does not agree with the actual date, particularly with respect to the number of days in the month.

SUMMARY OF THE INVENTION

It is an object of the invention therefore to create a watch embodying the foregoing features in which the correct display of the calendar dates is assured.

According to the invention, a year wheel (17) of a year display and a decade wheel (26) of a decade display, and possibly a century wheel of a century display, form, together with the wheelwork of the month display (57) and the day-of-the-month display (56), a closed, coupling-less calendar wheelwork train whose date wheel (13) can be set by a correction means. Since, in addition to the month and the day of the month, the number of the year and possibly even an indication of the century are displayed, and at the same time no individual adjustment of the different displays is possible, a dependable correction can always be effected by simultaneous monitoring of the display. The association of the individual displays with each other cannot be changed since the calendar wheelwork train is adjustable only as a whole by adjustment of the smallest display unit, namely the day of the month.

A reduction of the number of actuating elements can be obtained in the manner that the crown forms the correction means and is movable axially into a time-setting position for adjusting the time and into a correction setting position for correcting the calendar.

In one simple development, a shift finger (24) can be arranged fixed on the month wheel (22), a two-part, turnably mounted intermediate wheel (25) being adapted to be advanced by it, the two parts of the intermediate wheel (25) having the same pitch circle and the same pitch, the (first part of the) intermediate wheel (25) being provided completely with teeth and the second (part of the) intermediate wheel (25) having one-tenth the number of teeth that the first (part of the) intermediate wheel (25) has, the year wheel being adapted to be driven by the first part of the intermediate wheel (25) and the decade wheel (26) by the second part of the intermediate wheel (25). In this connection, the shift finger (24) can be adapted to be driven one revolution a year and the first part of the intermediate wheel (25), the year wheel and the decade wheel (26) each have ten teeth.

A construction which has only a small number of simple parts is obtained in the manner that the year wheel and the decade wheel (26) are arranged coaxially to each other and that the year wheel is firmly connected to a coaxial year display ring (27) which is surrounded by a decade display ring (28) which is firmly connected to the decade wheel (26).

An additional display of the century is possible in simple manner by providing on the decade wheel (decade display ring 28) a shift cam (30) by which a century slide (33) which is tangential to the decade display ring (28) and to the path of rotation of the shift cam (30) is displaceable.

In order to obtain also a display of the days of the week which is always correctly in agreement with the other displays, a day-of-the-week wheelwork of a day-of-the-week display (58) can form a closed, coupling-less wheelwork train together with the calendar wheelwork train. In this case, a swing lever (40) can be driven one swing deflection per day by the watch movement, by which a day-of-the-week wheel (44) which is turnable around a shaft can be advanced via a shift lever (42). The day-of-the-week wheel (44) preferably has seven teeth.

A simultaneous display of the phase of the moon which also is always in correct agreement with the calendar displays is obtained in the manner that a moon-phase drive of a moon-phase display forms a closed, coupling-less moon-phase wheelwork train with the calendar wheelwork train.

In order to keep the number of parts small, the moon-phase drive can be driven by the day-of-the-week drive, a moon phase wheel (46) being preferably firmly connected coaxially to the day-of-the-week wheel (44).

For the driving of the moon-phase display, the moon-phase drive can have a moon-phase intermediate wheel (47) which can be driven by the moon-phase wheel (46) and bears a step-down wheel (48) by which a display drive wheel (49) which is firmly connected to the moon-phase display can be driven. In this case, the moon-phase display can in a simple embodiment, have a moon disk (50) which is firmly connected coaxially to the display drive wheel (49).

If the transmission ratio of the day-of-the-week wheel (44) to the display drive wheel (49) is 8,4375:1 and if the moon disk (50) has two diagonally opposite moons (51), then such a high precision of the drive of the moon phase is obtained that the need for correction by only one day occurs only after 122 years.

The watch of the invention thus has a perpetual calendar with perpetual moon-phase display, they being jointly displaceable by merely a single total-correction device. The complete display of the calendar dates, including the century number, permits verification that all calendar and moon-phase functions of the watch are correctly programmed.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
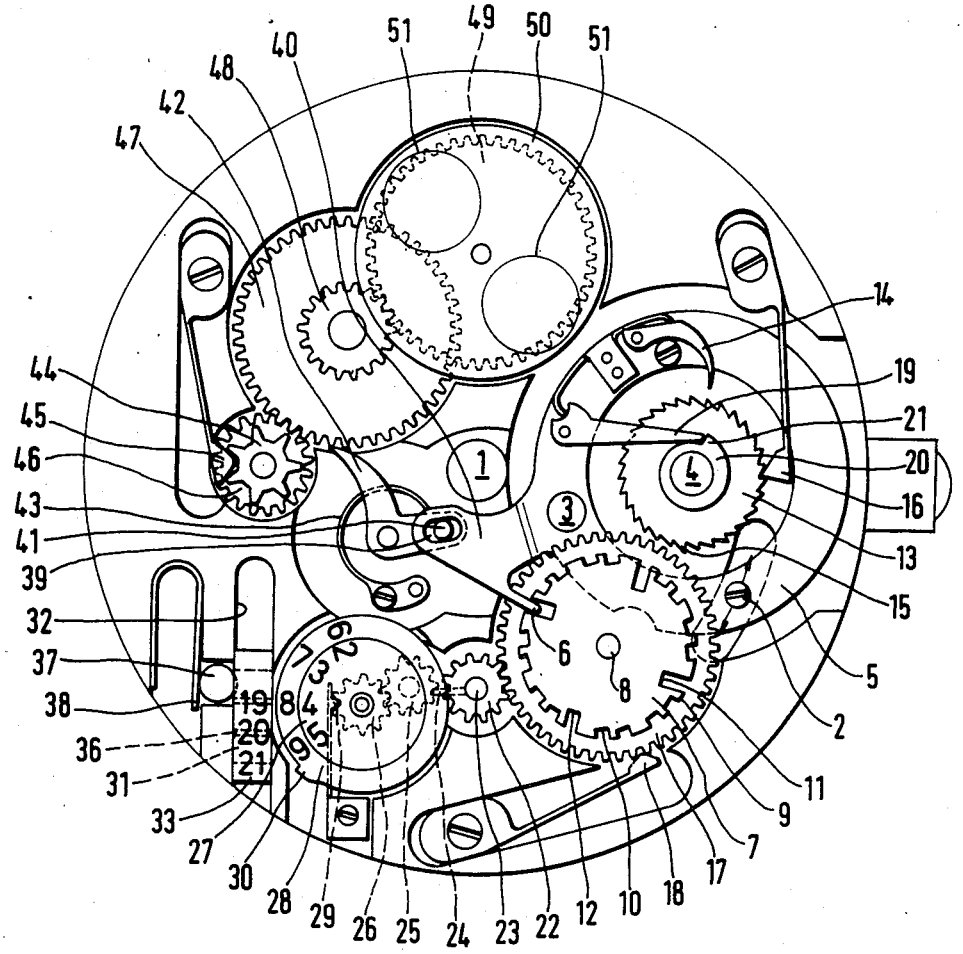
FIG. 1 is a view of the drive of an automatic calendar and moon-phase display.

Referring to FIGS. 1-5, 1 is an hour pipe of the motion work. By a drive (not shown) a lever 5 which is swingable around a shaft 4 is moved back and forth once a day by the watch movement.

A feeler arm 6 of the lever 5 has its free end resting radially from the outside against the circumferential periphery of a turnably mounted month step disk 7.

The month step disk 7 has on its circumferential periphery 20 notches and elevations each, they representing the 48 months of a leap-year period. By means of these elevations and depressions, the feeler arm 6 and the lever 5 can swing a greater or lesser distance towards a shaft of rotation 8 of the month step disk 7. The elevations 9 represent months having 31 days and the depressions 10, which are of smaller depth represent months of 30 days; the depressions 11 of greatest depth in each case represent February with 28 days and the depression 12 represents February of a leap year, having 29 days.

By the daily swinging movement of the lever 5, a date wheel 13 mounted turnably on the shaft 4 is turned in clockwise direction by means of a shift pawl 14. The shift pawl 14 engages in a tooth gap on the periphery of the date wheel 13, provided on its periphery with 31 radial sawtooth teeth. In order to prevent the date wheel 13 from turning further by itself, a detent lock 16 engages under spring action into a tooth gap.

One tooth 15 of the 31 teeth of the date wheel 13 extends further outward radially than the other teeth. At the end of each month, a gearwheel 17 having 48 teeth which is turnable on the shaft 8 and firmly connected to the month step disk 7 can be turned by one tooth in counterclockwise direction by said tooth 15. The gearwheel 17 is also secured against turning further by itself by a detent lock 18, which can engage under spring action into a tooth gap.

On the lever 5 there is turnably mounted an additional pawl 19 the free end of which rests under spring action against a spirally shaped eccentric cam 20. This eccentric cam 20 is firmly connected to the date wheel 13 and is turnable around the shaft 4.

The radially outer end of the spiral of the cam 20 which increases in radius in counterclockwise direction forms a stop 21 against which the tip of the free end of the additional pawl 19 can come to rest.

While due to the swinging of the lever 5 with the feeler arm 6 resting on an elevation 9 further movement of the date wheel 13 by the shift pawl 14 takes place by only one tooth, the somewhat larger path of swing of the lever 5 in the case of the depressions 10 on the last day of the month leads first to a turning of the date wheel 13 by one tooth by the additional pawl 19 and then to a turning by another tooth by means of the shift pawl 14.

The depressions 11 lead to a further shifting by three teeth and the depressions 12 by two teeth as a result of the additional pawl 19 before the shift pawl 14 advances further by one additional tooth.

As a result of this, the gearwheel 17 of the month disk 7 is always turned further correctly by the tooth 15 for the change of the month.

A turnably mounted month wheel 22 having 12 teeth also meshes with the gearwheel 17. A month display (not shown) is driven by the month wheel 22 (pointer on scale 57 in FIG. 2).

A radially protruding shift finger 24 is rigidly connected to the month wheel 22 and is turnable around the axis 23 thereof. This finger engages like a single tooth into a two-part intermediate wheel 25. The two parts of the intermediate wheel 25 which are arranged coaxially to and firmly connected to each other have the same pitch diameter and the same pitch.

The one part is developed completely with teeth—namely ten teeth—while 9 teeth are removed on the other part so that only a single tooth is present. The intermediate wheel 25 is advanced by the shift finger 24 by one tooth once a year.

Two identical gearwheels each having ten teeth mesh with the intermediate wheel 25. Said gearwheels are turnable coaxially alongside of each other but independently of each other around an axis.

The one gearwheel meshes with the part of the intermediate gear 25 which has ten teeth and forms a year wheel while the other gearwheel meshes with the part of the intermediate wheel 25 having one tooth and forms a decade wheel 26. In this way the year wheel is moved once a year by one tooth and the decade wheel 26 is moved once every ten years by one tooth.

The year wheel is firmly connected to a coaxial year display ring 27 and the decade wheel 26 to a decade display ring 28 which surrounds the year display ring 27, both the year display ring 27 and the decade display ring 28 bearing numbers from 1 to 9 printed thereon. The decade wheel 26 and the year wheel are secured against turning further by themselves by means of detent locks 29.

Radially protruding from the decade display ring 28 there is a shift projection 30 which can engage in recesses 31 in a century slide 33 which is guided slidably tangential to the decade display ring 28 in a guide groove 32. In this connection, the recesses 31 in the lengthwise direction of the century slide 33 are so arranged one behind the other that after each decade revolution of the decade display ring 28 the century slide 33 is moved further by an amount equal to one recess.

Since one century number is printed on the century slide 33 for each spacing, the complete year is indicated by the radially adjacent digits of the century slide 33, the decade display ring 28 and the year display ring 27, the year being visible to an observer through a window 34 in the dial 35.

The recesses 31, separated by arms 36, extend continuously across the century slide 33. On the side opposite the decade display ring 28, a detent device engages on the century slide 33, it securing the latter in its position after each displacement.

This detent device consists of a disk 37 which is of a larger diameter than a recess 31 and is guided transversely to the century slide 33 in a guide, the disk being urged by a spring 38 in each case partially into the recess 31.

The lever 5 has a radially protruding part which forms a swing lever 40 on which there is developed a slot 39 into which a pin 41 extends. The pin 41 is swingable on the free end of a lever arm of a double-armed shift lever 42 which is swingable about an axis. The free end of the other lever arm of the shift lever 42, upon the daily swinging motion of the latter, turns a 7-tooth day-of-the-week wheel 44 further by one tooth division. The shift lever 42 is brought out of engagement with the day-of-the-week wheel 44 by a spring 43.

The day-of-the-week wheel 44 which is connected with a day-of-the-week display (pointer on scale 58, FIG. 2) is secured against turning by itself by a detent lock 45 which engages under spring action in a tooth gap.

A moon-phase wheel 46 is firmly connected coaxially to the day-of-the-week wheel 44 and meshes with a moon-phase intermediate wheel 47. The moon-phase intermediate wheel 47 in its turn, is firmly connected coaxially to a step-down wheel 48 which meshes with a display drive wheel 49. A moon disk 50 is coaxially connected to the display drive wheel 49, two moons 51 being arranged diagonally opposite each other on the moon disk.

The transmission ratio from day-of-the-week wheel 44 to display drive wheel 49 is 8.4375:1. Thus the display drive wheel 49 is turned once every 59.0625 days.

Since the moon disk 50 is provided with two moons 51, one moon period of the display lasts for 29.53125 days. As compared with the actual moon period of 29.53059 days, this is a deviation of only 0.00066 days per moon period, which means a difference of one day in 122 years.

The high degree of accuracy of the moon-phase display together with the complete automatic display of the calendar dates including the year number has the advantage that none of the displays ever has to be adjusted individually. The entire calendar is permanently programmed up to Mar. 1, 2100. Only then is a slight correction by a watchmaker necessary.

Due to the fixed programming and the correction by means of the crown no correction buttons are necessary, which on the one hand simplifies the operation of the watch and makes rapid correction of all displays possible. On the other hand, this development permits a water-tight development of the watch in simple manner.

The small number of parts as a result of the elimination of the individual correction devices contributes to the production of watches of smaller size and in particular of smaller structural height.

Figure 2:
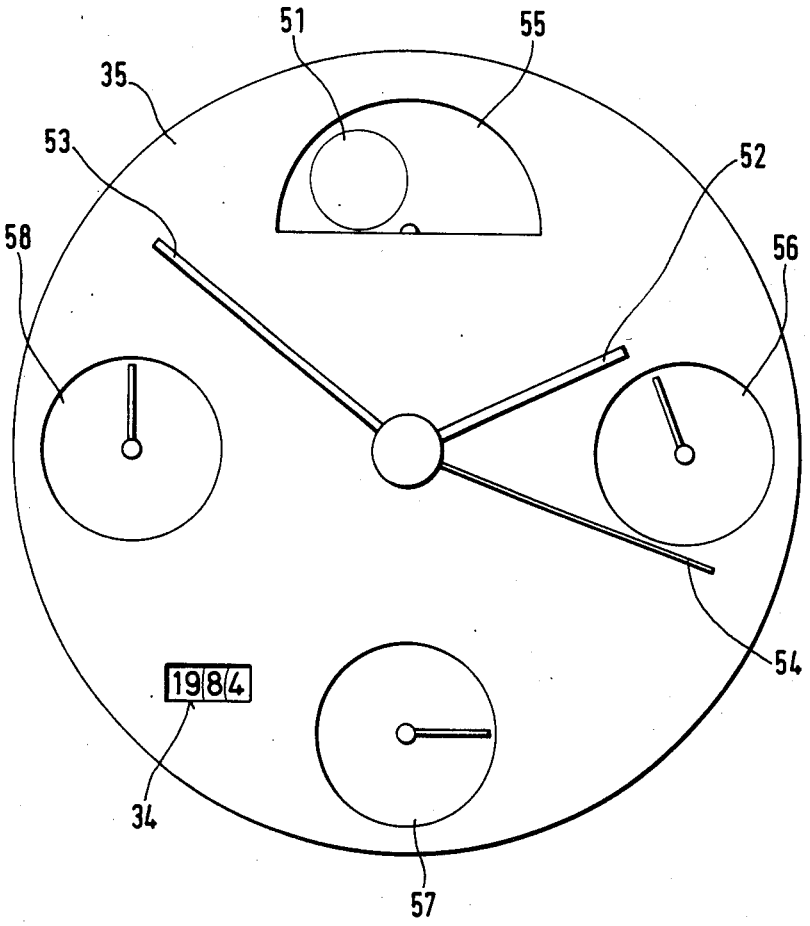
FIG. 2 is a view of the dial of the watch of FIG. 1.
Figure 3:
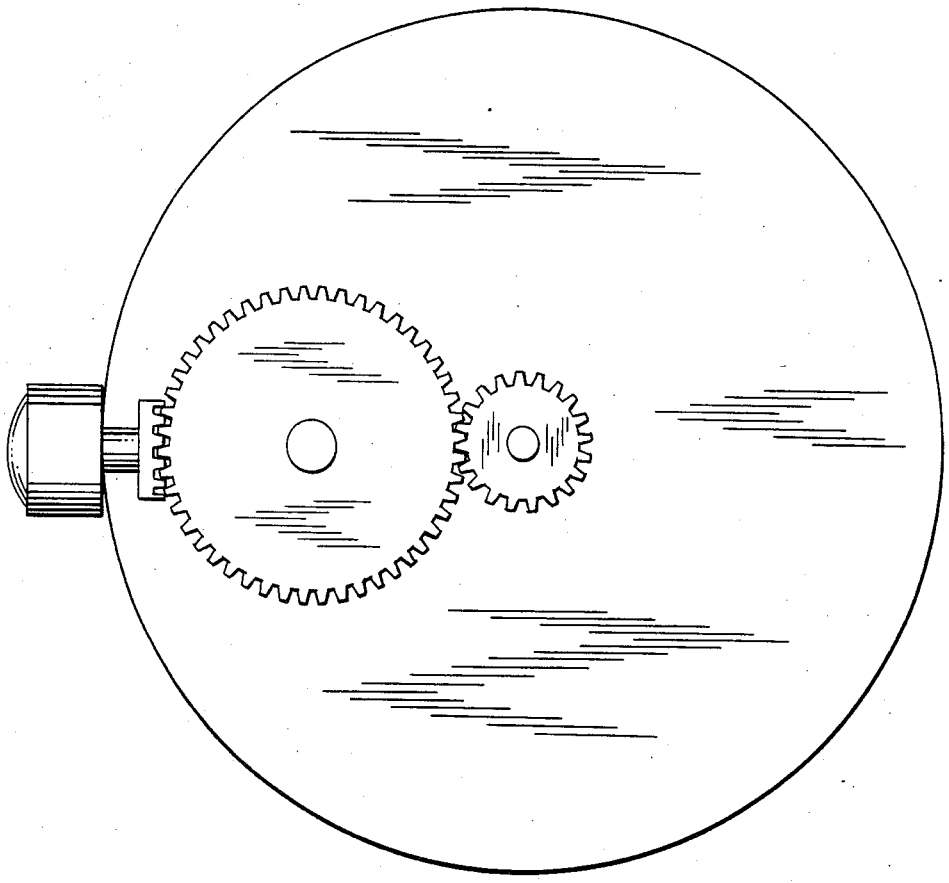
FIG. 3 is a partial view of the watch drive of FIG. 1 showing a crown and correction gears.
Figure 4:
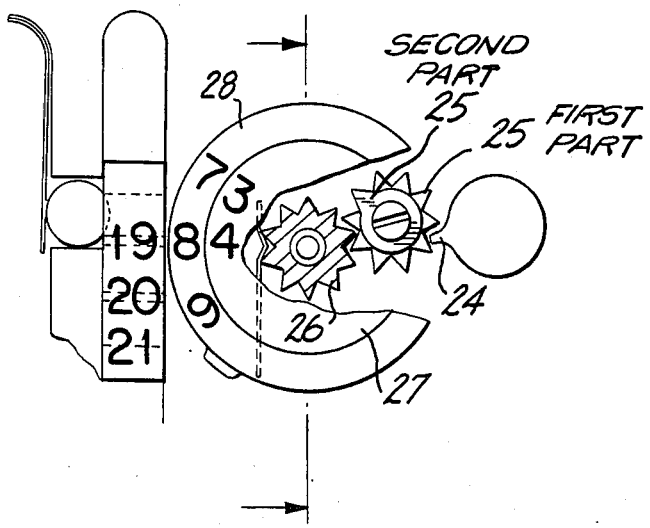
FIG. 4 is a detailed fragmentary view of the mechanism of FIG. 1 showing the year display.
Figure 5:
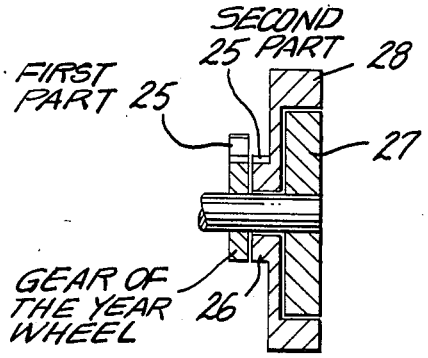
FIG. 5 is a side sectional view of the mechanism of FIG. 4.

As shown in FIG. 2, the dial 35 of the watch, which is moved over by an hour hand 52, a minute hand 53 and a second hand 54, also bears the calendar and moon-phase displays. For this purpose, a window 55 is provided for the moon-phase display, a scale with pointer for the date display 56, a scale with pointer for the month display 57, a scale and a pointer for the day-of-the-week display 58, and the window opening 34 for the year display.

I claim:

1. In a watch having a crown for setting hands of the watch, the crown also setting a device which can be driven by the hour wheel of a watch movement for operating a day-of-the-month display to automatically display the month and the day of the month in accordance with the Gregorian calendar, the day-of-the-month display being driven by a date wheel of the device and the month display being driven by a month wheel of the device, the improvement comprising a year wheel of a year display including a first gear, a decade wheel of a multiple-year display including a second gear, together with a wheel work of the month display and the day-of-the-month display including a third gear; and a closed coupling-less calendar wheelwork train allowing the date wheel to be set by a correction means, said calendar wheelwork train comprising said first and said second and said third gears.

2. The watch as set forth in claim 1, wherein said multiple-year display comprises a decade display.

3. The watch as set forth in claim 2, wherein said multiple-year display further comprises a century wheel of a century display.

4. The watch as set forth in claim 1, wherein the crown forms the correction means, and is movable axially into a time-setting position for adjusting the time and into a correction setting position for correcting the calendar.

5. In a watch having a corwn for setting hands of the watch, the crown also setting a device which can be driven by the hour wheel of a watch movement for operating a day-of-the-month display to automatically display the month and the day of the month in accordance with the Gregorian calendar, the day-of-the-month display being driven by a date wheel of the device and the month display being driven by a month wheel of the device, the improvement comprising a year wheel of a year display and a decade wheel of a multiple-year display which form, together with a wheelwork of the month display and the day-of-the-month display, a closed, coupling-less calendar wheelwork train allowing the date wheel to be set by a correction means; the watch further comprising a shift finger disposed on the month wheel;

a two-part, turnably mouned intermediate wheel mechanically coupled to the shift finger to be advanced by the shift finger, the two parts of the intermediate wheel having the same pitch circle and the same pitch, the first part of the intermediate wheel being provided completely with teeth, and the second part of the intermediate wheel having one-tenth the number of teeth as that of the first part of the intermediate wheel; and wherein the year wheel is driven by the first part of the intermediate wheel and the decade wheel is driven by the second part of the intermediate wheel.

6. The watch as set forth in claim 5, wherein the shift finger is driven one revolution a year, and wherein the first part of the intermediate wheel, the year wheel and the decade wheel each have ten teeth.

7. In a watch having a crown for setting hands of the watch, the crown also setting a device which can be driven by the hour wheel of a watch movement for operating a day-of-the-month display to automatically display the month and the day of the month in accordance with the Gregorian calendar, the day-of-the-month display being driven by a date wheel of the device and the month display being driven by a month wheel of the device, the improvement comprising a year wheel of a year display and a decade wheel of a multiple-year display which form, together with a wheelwork of the month display and the day-of-the-month display, a closed, coupling-less calendar wheelwork train allowing the date wheel to be set by a correction means; and wherein said year wheel and the decade wheel are arranged coaxially to each other; the watch further comprising a decade display ring, and a coaxial year display ring which is surrounded by the decade display ring and which is firmly connected to the decade wheel, and wherein the year wheel is firmly connected to the coaxial year display ring.

8. The watch as set forth in claim 7, further comprising a century slide and wherein, on the decade wheel and decade display ring, there is disposed a shift cam, the century slide being tangential to the decade display ring and to the path of rotation of the shift cam, the century slide being displaceable by the shift cam.

9. The watch as set forth in claim 1, further comprising a day-of-the-week wheelwork of a day-of-the-week display which is formed as a closed, coupling-less wheelwork train together with the calendar wheelwork train.

10. The watch as set forth in claim 9, further comprising a shift lever, a swing lever, and a day-of-the-week wheel; and wherein the swing lever is driven by one swing deflection per day by the watch movement, to operate the day-of-the-week wheel, the day-of-the-week wheel being turnable around a shaft and advanced via the shift lever.

11. The watch as set forth in claim 10, wherein said day-of-the-week wheel has seven teeth.

12. The watch as set forth in claim 1, further comprising a moon-phase drive of a moon-phase display, the moon-phase drive forming a closed, coupling-less moon-phase wheelwork train with the calendar wheelwork train.

13. The watch as set forth in claim 12, further comprising a day-of-the-week drive including the day-of-the-week wheel, and wherein the moon-phase drive is driven by the day-of-the-week drive.

14. The watch as set forth in claim 13, wherein the moon-phase display includes a moon-phase wheel firmly connected coaxially to the day-of-the-week wheel.

15. The watch as set forth in claim 14, further comprising a display-drive wheel firmly connected to the moon-phase display, and wherein the moon-phase drive has a moon-phase intermediate wheel which is driven by the moon-phase wheel and bears a step-down wheel, the display drive wheel being driven by the step-down wheel.

16. The watch as set forth in claim 15, wherein the moon-phase display has a moon disk which is firmly connected coaxially to the display drive wheel.

17. The watch as set forth in claim 16, wherein a transmission ratio of the day-of-the-week wheel to the display drive wheel is 8,4375:1, and the moon disk has two diagonally opposite moons.

* * * * *